US005186467A

United States Patent [19]

Chasin

[11] Patent Number: 5,186,467

[45] Date of Patent: Feb. 16, 1993

[54] SPORTS GAME

[76] Inventor: Leonard Chasin, 220 Everit Ave., Hewlett Harbor, N.Y. 11557

[21] Appl. No.: 826,221

[22] Filed: Jan. 23, 1992

Related U.S. Application Data

[63] Continuation of Ser. No. 574,278, Aug. 28, 1990.

[51] Int. Cl.[5] ..... A63F 9/18

[52] U.S. Cl. ..... 273/298; 273/244; 273/296; 273/430; 434/347

[58] Field of Search ..... 273/93 R, 93 C, 244, 273/272, 296, 298, 302, 303, 429, 430, 431, 432; 434/209, 322, 323, 327, 347

[56] References Cited

U.S. PATENT DOCUMENTS

| | | | |
|---|---|---|---|
| 2,901,839 | 9/1959 | Huff | 434/209 |
| 4,261,569 | 4/1981 | Frolich | 273/93 C |
| 4,323,249 | 4/1982 | Brady | 273/302 X |
| 4,486,022 | 12/1984 | Dixon | 273/244 X |
| 4,732,393 | 3/1988 | Rita | 273/296 X |
| 4,822,043 | 4/1989 | Carter | 273/93 C |
| 4,846,480 | 7/1989 | Oliver | 273/292 |
| 4,900,031 | 2/1990 | Wohl | 273/272 X |

*Primary Examiner*—Theatrice Brown
*Assistant Examiner*—William M. Pierce
*Attorney, Agent, or Firm*—Lieberman, Rudolph & Nowak

[57] ABSTRACT

Two decks of cards are employed in an enjoyable sports trivia and memorabilia game which stimulates a player's ability to recall players on famous sports teams. The first deck of cards is composed of cards having a number printed on one side. The second deck of cards is composed of cards having a team name and year printed on the first side and a list of the team players and their corresponding numbers printed on the reverse side. The object of the game is to match the number on the card drawn from the first deck with the player on the team listed on the card from the second deck. A correct match of a player and number scores a point, a game board and tokens may be used to keep score by covering the position of the player who corresponds to the correctly matched player and number.

8 Claims, 8 Drawing Sheets

1986 New York Mets

| No. | Team Member | Pos. | Bats | Throws |
|---|---|---|---|---|
| 1 | Mookie Wilson | OF | S | R |
| 2 | Kevin Elster | SS | R | R |
| 3 | Rafael Santana | SS | R | R |
| 4 | Lenny Dykstra | OF | L | L |
| 5 | Davey Johnson | MGR | | |
| 6 | Wally Backman | 2B | S | R |
| 7 | Kevin Mitchell | OF | R | R |
| 8 | Gary Carter | C | R | R |
| 11 | Tim Teufel | 2B | R | R |
| 12 | Ron Darling | P | R | R |
| 13 | Lee Mazzilli | OF | S | R |
| 16 | Dwight Gooden | P | R | R |
| 17 | Keith Hernandez | 1B | L | L |
| 18 | Daryl Strawberry | OF | L | L |
| 19 | Bob Ojeda | P | L | L |
| 20 | Howard Johnson | 3B | S | R |
| 22 | Ray Knight | 3B | R | R |
| 25 | Danny Heep | OF | L | L |
| 35 | John Gibbons | C | R | R |
| 38 | Rick Aguilera | P | R | R |
| 39 | Doug Sisk | P | R | R |
| 40 | Randy Niemann | P | L | L |
| 42 | Roger McDowell | P | R | R |
| 47 | Jesse Orosco | P | R | L |
| 49 | Ed Hern | C | R | R |
| 50 | Sid Fernandez | P | L | L |

METS

1986

FIG. 2A

1986 New York Mets

| No. | Team Member | Pos. | Bats | Throws |
|---|---|---|---|---|
| 1 | Mookie Wilson | OF | S | R |
| 2 | Kevin Elster | SS | R | R |
| 3 | Rafael Santana | SS | R | R |
| 4 | Lenny Dykstra | OF | L | L |
| 5 | Davey Jonhson | MGR | | |
| 6 | Wally Backman | 2B | S | R |
| 7 | Kevin Mitchell | OF | R | R |
| 8 | Garyl Carter | C | R | R |
| 11 | Tim Teufel | 2B | R | R |
| 12 | Ron Darling | P | R | R |
| 13 | Lee Mazzilli | OF | S | R |
| 16 | Dwight Gooden | P | R | R |
| 17 | Keith Hernandez | 1B | L | L |
| 18 | Daryl Strawberry | OF | L | L |
| 19 | Bob Ojeda | P | L | L |
| 20 | Howard Johnson | 3B | S | R |
| 22 | Ray Knight | 3B | R | R |
| 25 | Danny Heep | OF | L | L |
| 35 | John Gibbons | C | R | R |
| 38 | Rick Aguilera | P | R | R |
| 39 | Doug Sisk | P | R | R |
| 40 | Randy Niemann | P | L | L |
| 42 | Roger McDowell | P | R | R |
| 47 | Jesse Orosco | P | R | L |
| 49 | Ed Hern | C | R | R |
| 50 | Sid Fernandez | P | L | L |

FIG. 3A

1955 Brooklyn Dodgers

| No. | Team Member | Pos. | Bats | Throws |
|---|---|---|---|---|
| 1 | Pee Wee Reese | SS | R | R |
| 4 | Duke Snider | OF | L | R |
| 6 | Carl Furillo | OF | R | R |
| 8 | George Shuba | OF | L | R |
| 10 | Al Walker | C | L | R |
| 12 | Frank Kellert | 1B | R | R |
| 14 | Gil Hodges | 1B | R | R |
| 15 | Sandy Amoros | OF | L | L |
| 17 | Carl Erskine | P | R | R |
| 19 | Jim Gilliam | 2B | S | R |
| 23 | Don Zimmer | 2B | R | R |
| 24 | Walter Alston | MGR | | |
| 30 | Billy Loes | P | R | R |
| 32 | Sandy Koufax | P | R | L |
| 34 | Russ Meyer | P | S | R |
| 36 | Don Newcombe | P | L | R |
| 37 | Ed Roebuck | P | R | R |
| 39 | Roy Campanella | C | R | R |
| 40 | Roger Craig | P | R | R |
| 41 | Clem Labine | P | R | R |
| 42 | Jackie Robinson | 3B | R | R |
| 43 | Don Hoak | 3B | R | R |
| 45 | John Podres | P | L | L |
| 46 | Don Bessent | P | R | R |
| 48 | Karl Spooner | P | R | L |
| 54 | Dixie Howell | C | R | R |

Fig. 3B

1974 American League All - Stars

| No. | Team Member | Pos. | Team Name | Bats | Throws |
|---|---|---|---|---|---|
| 1 | Bobby Murcer | OF | Yankees | L | R |
| 1 | Cookie Rojas | 2B | Royals | R | R |
| 3 | Bobby Grich | 2B | Orioles | R | R |
| 5 | Brooks Robinson | 3B | Orioles | R | R |
| 6 | Sal Bando | 3B | A's | R | R |
| 6 | Al Kaline | OF | Tigers | R | R |
| 7 | John Mayberry | 1B | Orioles | L | L |
| 7 | Dave Chalk | SS | Angels | R | R |
| 8 | Carl Yastrzemski | 1B | Red Sox | L | R |
| 9 | Reggie Jackson | OF | A's | L | L |
| 12 | Ed Hermann | C | White Sox | L | R |
| 15 | Thurman Munson | C | Yankees | R | R |
| 15 | Darrell Porter | C | Brewers | L | R |
| 15 | Dick Allen | 1B | White Sox | R | R |
| 18 | John Hiller | P | Tigers | R | L |
| 19 | Bert Campaneris | SS | A's | R | R |
| 20 | Jeff Burroughs | OF | Rangers | R | R |
| 20 | Geore Hendriox | OF | Indians | R | R |
| 20 | Frank Robinson | OF | Angels | R | R |
| 23 | Dick Williams | MGR | | | |
| 23 | Luis Tiant | F | Red Sox | R | R |
| 26 | Joe Rudi | OF | A's | R | R |
| 27 | Carlton Fisk | C | Red Sox | R | R |
| 27 | Jim Hunter | P | A's | R | R |
| 28 | Wilbur Wood | P | White Sox | R | L |
| 29 | Rod Carew | 2B | Twins | L | R |
| 34 | Rollie Fingers | P | A's | R | R |
| 35 | Mike Cueller | P | Orioles | L | L |
| 36 | Gaylord Perry | P | Indians | R | R |
| 40 | Steve Busby | P | Royals | R | R |

FIG. 3C

SPORTS GAME

This is a continuation of application Ser. No. 574,278, filed Aug. 28, 1990.

BACKGROUND OF THE INVENTION

There has long been a need for a sports game which provides enjoyment while stimulating a person's ability to recall players on famous sports teams. The subject invention provides a game which accomplishes this goal while providing intriguing variations in play which allow the game to be adapted to players of differing skill levels. In addition, this flexibility in design makes the game ideally suited for play between family members of different generations.

A further aspect of the subject invention is its ability to conjure up nostalgic moments. With society's increased awareness of nostalgia and collectors' interest in memorabilia, the subject game acts as a bridge between memorabilia and the recall of associated events.

Different sports trivia games have been described in the past. U.S. Pat. No. 4,856,780, issued Aug. 15, 1989 to Begley et al., discloses a trivia game in which players roll dice to advance a token around a game board while answering trivia questions. Although Begley, et al. use sports trivia in a game, it does not allow a player to correlate members of famous teams with the team to which they belonged. U.S. Pat. No. 305,315, issued Sept. 16, 1884 to Lawson, describes a set of playing cards useful for playing a game of card-baseball. Only one deck of cards is used and no aspect of trivia is present. Likewise, U.S. Pat. No. 2,687,306, issued Aug. 24, 1954 to Cheng, teaches a deck of cards which have markings thereon designating a number of balls in either red or black. The card game is played by drawing and discarding cards and scoring points based upon the combination of cards drawn.

U.S. Pat. No. 4,542,357, issued Nov. 12, 1985 to Di Egidio, provides a non-card game in which a player must match a sports team with its geographic location.

The subject invention provides a solution to the long felt need for a recall-stimulating and entertaining sports game.

SUMMARY OF THE INVENTION

The subject invention provides a sports game which uses means for generating a first set of information, namely a number corresponding to the uniform number of a team member; means for generating a second set of information, namely a list of the team members and their corresponding uniform numbers for a particular team name in a particular year; and an optional playing field board to mark progress in the game. Alternative means such as a video or computer game display may also be used. Means for generating a number corresponding to the uniform number of a team member typically comprises first deck of cards (or an electronic equivalent) composed of a plurality of cards with each card having a number printed on one side. The trivia and memorabilia game also typically includes as a means for generating a second set of information, a second deck of cards composed of a plurality of cards with each card in the second deck having a team name and year printed on the first side and a list of the team members and their corresponding uniform (jersey) numbers on the reverse side. The subject sports trivia game may be used in a number of different games which may be played by one or more players.

BRIEF DESCRIPTION OF THE FIGURES

FIG. 2A shows the first side of a card from the second deck depicting the 1986 New York Mets FIG. 3A shows the reverse side of a card from the second deck depicting the roster of the 1986 New York Mets FIG. 3B shows the reverse side of a card from the second deck depicting the roster of the 1955 Brooklyn Dodgers FIG. 3C shows the reverse side of a card from the second deck depicting the roster of the 1974 American League All-Stars

DETAILED DESCRIPTION OF THE INVENTION

Figure 1:
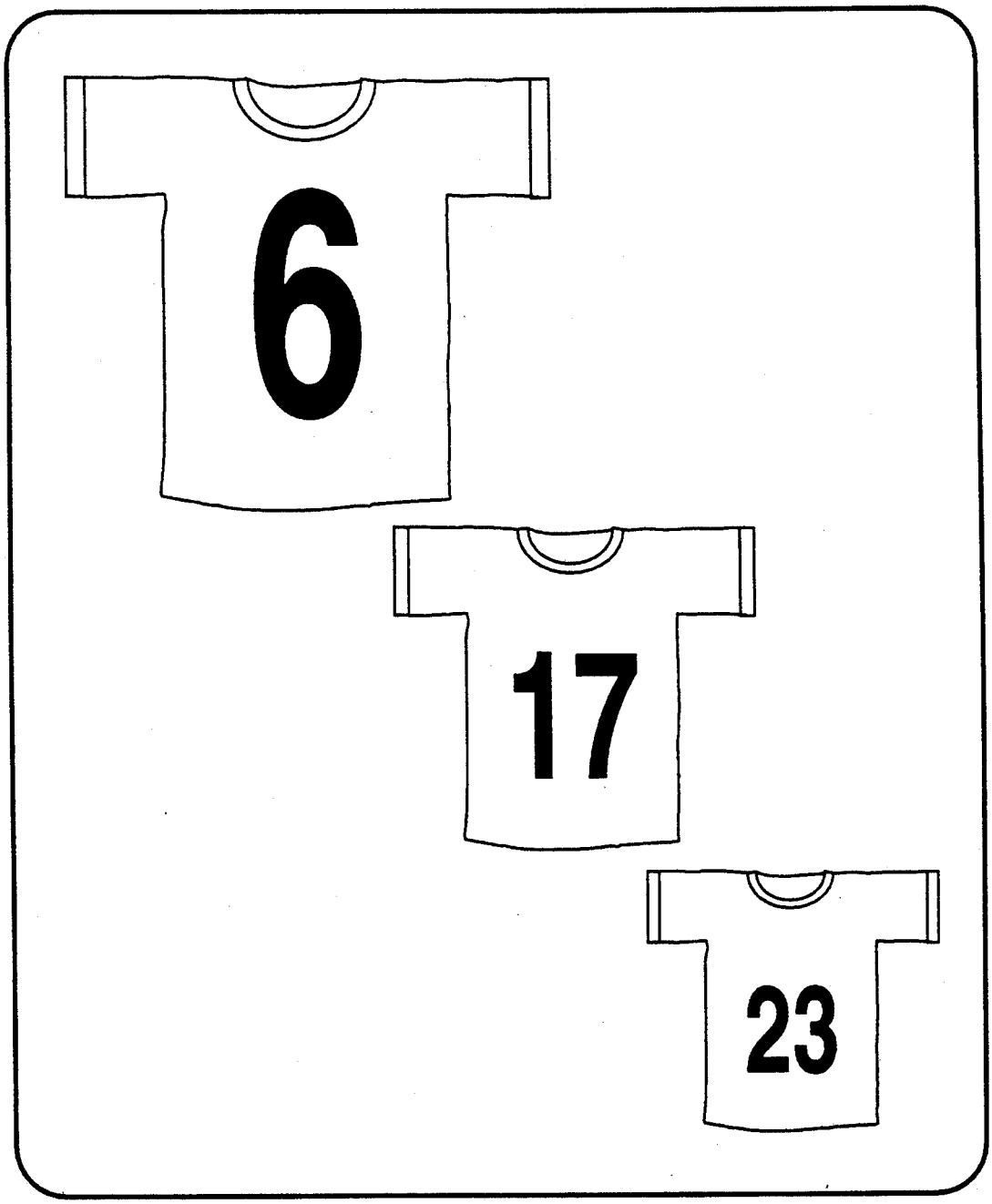
FIG. 1 shows the number side of a card from the first deck.

The subject invention provides a sports game which uses means for generating a first set of information, namely a number corresponding to the uniform number of a team member, and means for generating a second set of information, namely a list of the team members and their corresponding uniform numbers for a particular team name in a particular year.

The preferred version of the subject invention is a sports trivia and memorabilia game which comprises two decks of cards. It is to be understood that the phrase "deck of cards" and the term "card" as used in the subject application are to include any video or computer generated simulation thereof and equivalent graphic or audio representations. The first deck of cards is composed of a plurality of cards with each card having a number printed on one side with the reverse side being either blank or imprinted with a design. The number printed on each card corresponds to the uniform (jersey) number worn by a team member. Throughout the specification these numbers will be referred to as uniform numbers. The trivia and memorabilia game also includes a second deck of cards composed of a plurality of cards with each card in the second deck having a team name and year printed on a first side and a list (roster) of the team members and their corresponding uniform numbers on the second side. The subject sports game may be used in a number of different games and variations which may be played by one or more players. It is to be understood, therefore, that while one version of baseball is used as illustrative, other sports and other variations of play are possible and are to be considered within the scope and spirit of the subject invention.

The first deck of cards is primarily used to generate a uniform number for use in the sports game. As indicated, the phrase "first deck of cards" is to be understood to encompass alternate number generating means, for example, dice or a computer. In the preferred embodiment, the cards in the first deck have three numbers with each number printed on a stylized sports jersey. Most preferably, the uniform numbers printed on the card, are selected by statistical analysis so that common uniform numbers are printed in greater numbers than rarer uniform numbers, and the backup alternatives are statistically distributed to minimize the number of cards not identifying a listed team member.

The cards of the second deck have an element of collectability. It is envisioned that the sports game will include a set of cards, for example, all league and world championship teams from 1950–1990, and that additional sets of cards will be issued independently, for example, All-Star teams, or Yankee teams, etc. Players will, by trading cards, be able to customize the game to best suit their needs. Additionally, special limited editions of cards may be issued which will further increase the memorabilia/collectability value of the cards. In a preferred embodiment, the cards will be printed on a high grade, acid-free, laminated paper which will prolong the life of the cards.

The following is a description of one variation of the game involving multiple players, which is currently the best version known.

To determine who goes first, each player draws a card from the first deck which is positioned with the numbered side of the cards in a face-down position so as to prevent the numbers from being seen by the players. FIG. 1 illustrates one embodiment of a card from the first deck. Each player picks a card and the player with the highest card goes first. If, as is preferred, there are multiple uniform numbers appearing on the card, the player having uniform numbers totaling the greatest sum goes first. The cards in both decks can be held in a card holder; however, this is not essential to the practice of the invention.

Figure 2B:
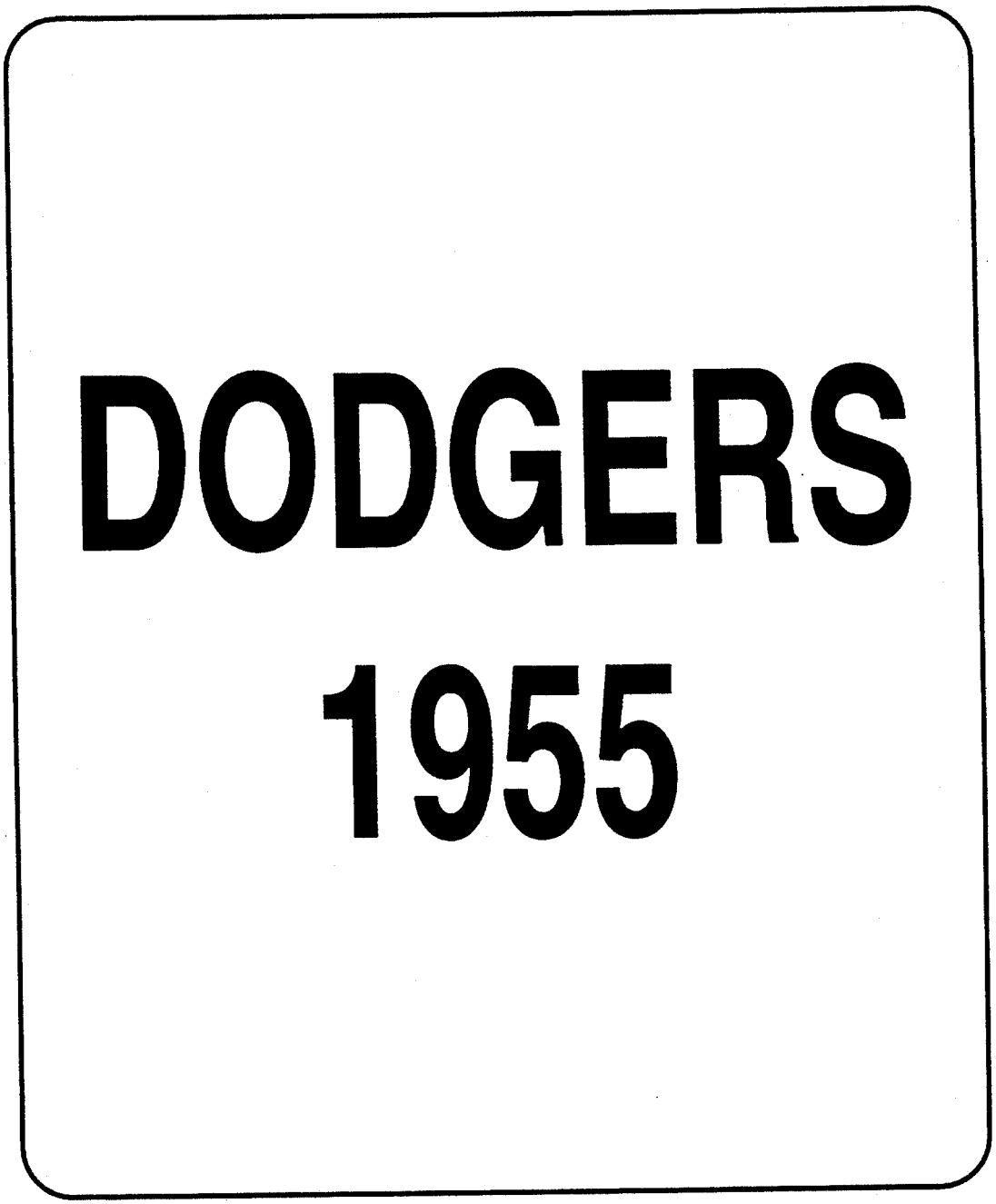
FIG. 2B shows the first side of a card from the second deck depicting the 1955 Brooklyn Dodgers
Figure 2C:
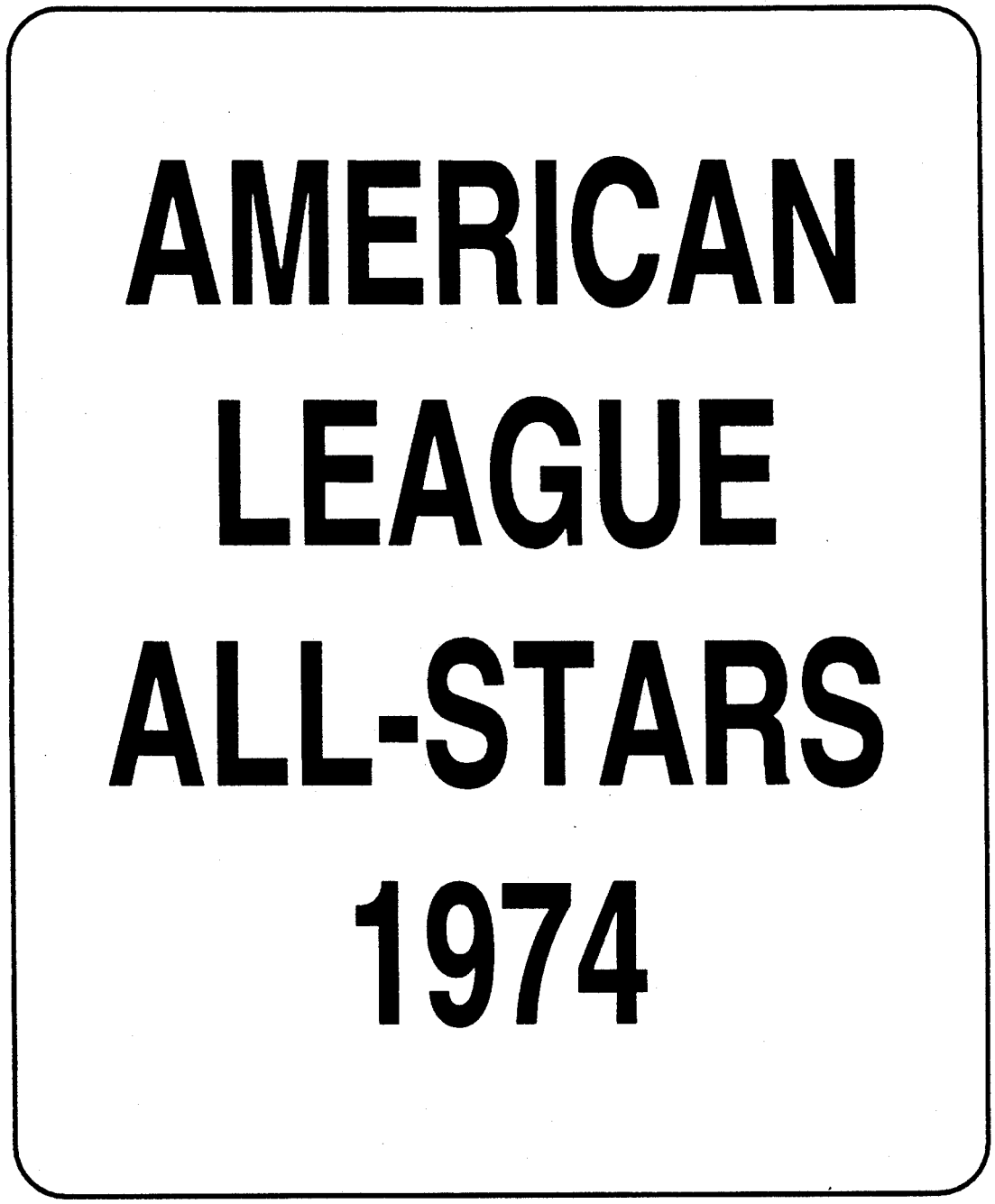
FIG. 2C shows the first side of a card from the second deck depicting the 1974 American League All-Stars Team

The first player (player one) draws a card from the first deck and places it face up thereby exposing the uniform number or series of uniform numbers to all of the players. A card from the second deck is then picked up by another player and placed with the first side of the card facing up thereby allowing the players to see the team name and year (for example, Mets 1986). Preferably, if there are three (3) players, the player to the right of the first player picks up the card from the second deck; if four (4), the player opposite the first player picks up the card. FIG. 2 depicts an example of the first side of a card from the second deck.

The player who picks the card from the second deck (player two) then looks at the second side of the card and can inform player one if there is a member having the uniform number printed on the card drawn by player one from the first deck (for example, if player one draws a 6, he has to know if a team number with number 6 played for the 1986 Mets). If there is no team member having the uniform number corresponding to the uniform number drawn by player one, a second card may be drawn by player one. One variation of the game allows cards drawn from the first deck on which uniform do not correspond to a team member on the card draw from the second deck to be retained by the first player for use on a later turn. In a preferred embodiment, the cards in the first deck have a plurality of uniform numbers on one side of each card. If no member of the team has the first uniform number then the second listed uniform number is used. If no member of the team has the second uniform number then the third listed uniform number is used.

The teams appearing on the cards of the second deck may include All-Star or other special teams. All-Star teams typically have more than one team member with the same number. If a player picking up the card from the second deck notices that two members of the team have the same number and if clues are being given (see below), then he may choose which team member to use for giving clues.

Player one must then guess the name of the team member which matches the number drawn (for example, if the card drawn from the deck second deck reads Mets 1986 and player one draws an 18, then he must guess Daryl Strawberry to be credited with a correct answer).

The subject invention also allows for competition between players of disparate skill. In one embodiment, the second side of the cards in the second deck may also have clues to reduce the level of skill and memory required to play the game. For example, next to the team member's number and name may be clues such as bats left handed, throws right handed or the position played (e.g., centerfield, first base, etc.).

Figure 4:
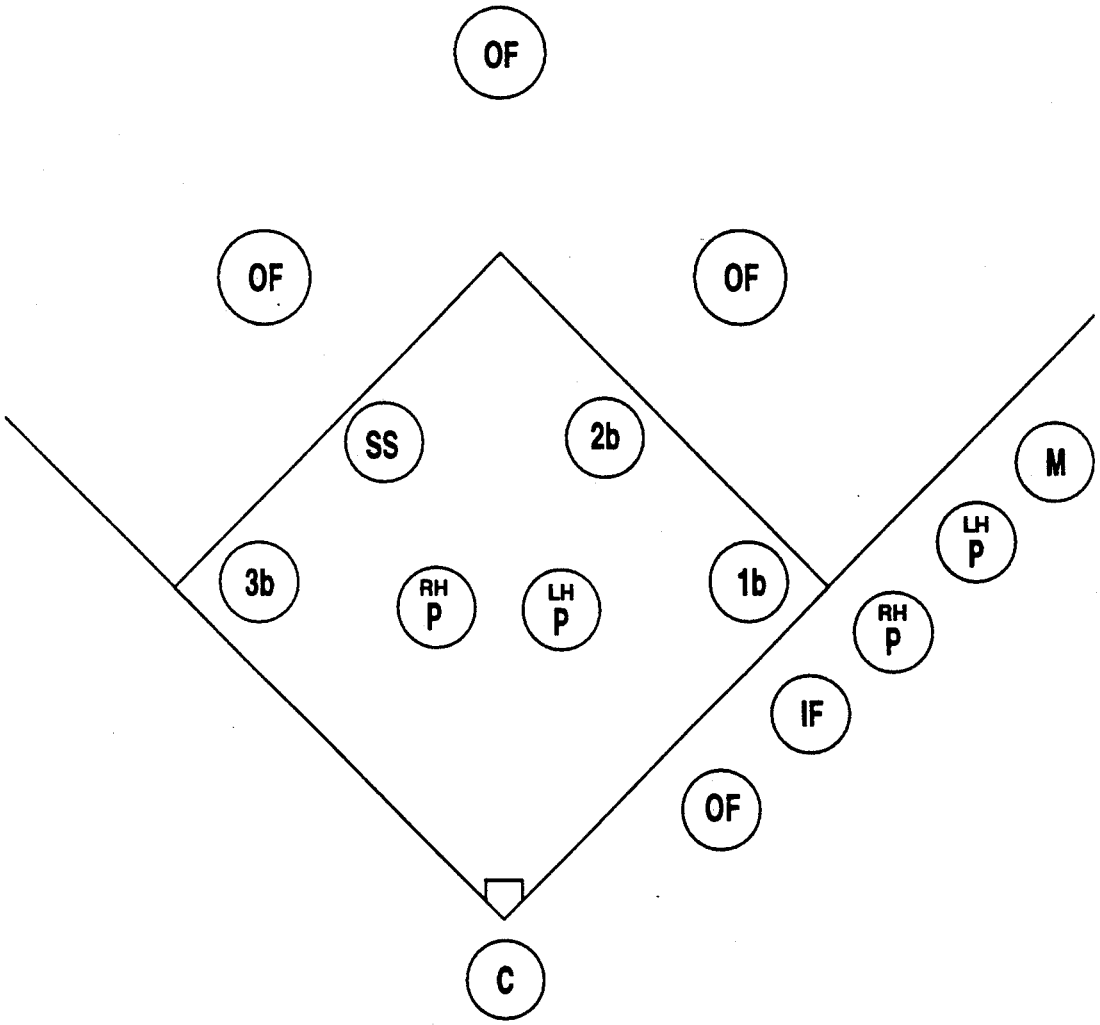
FIG. 4 shows a top plan view of a baseball game board.

To vary the level of difficulty, the holder of the card may read one or more clues from the second side of the card from the second deck. For example, whereas a master player would be given only a acknowledgment that there is a player on the team with the selected number, a less skilled player would be told the player's initials, position, batting handedness, or throwing arm. In a preferred embodiment, the subject invention comprises means for recording correctly guessed team member/uniform number combinations. Means for recording correctly guessed team member/uniform number combinations typically comprise a game board depicting a sports field having spaces for recording correctly guessed team member/uniform number combinations. FIG. 4 shows an example of such a field wherein the sport is baseball. Round spaces for placing the tokens are depicted for the positions first base(1B), second base(2B), third base(3B), short stop(SS), right-handed pitcher(RHP), left-handed pitcher(LHP), catcher(c), three outfielders(OF), and the bench positions of reserve outfielder(OF) and infielder(IF) right(RHP) and left-handed (LHP) reserve pitchers, and manager(M). Other position variations which may be incorporated into a game board include additional reserve players and coaches. Football, hockey, etc., have their own boards and numbers of positions. If the first player correctly guesses the player having the chosen number, he is given a token. This player then takes the token and places it on the position of the team member he has guessed. The player may then draw another card and the process of play is repeated until the player guesses incorrectly at which time the second player takes his or her turn, and so on.

In the preferred embodiment, the first deck of cards also contains one or more cards having the term "take a player" or "lose a player". If a player draws a "take a player" card, he receives a token which may be placed on the position of any team member on the game board with the only exceptions (under one preferred variation and set of rules) being that the token may not be used to cover the last uncovered position and may not be used to cover a manager position. If a player draws a "lose a player" card, the player holding the card from the second deck may remove any token from the player's game board and may place the token at any position on his own board, with the only exceptions being that the token may not be used to cover the last uncovered position and may not be used to cover the manager position. In the preferred embodiment, a player also cannot lose a manager position token by drawing a "lose a player" card.

As the game progresses, a player may be awarded a second token for a given position. The second token may be stacked upon the first token received for that position. In the preferred embodiment, if a player receives a third token for a given position, he may trade the top two tokens for a single token usable at any position on his own board with the only exceptions being that the token may not be used to cover the last uncovered position and may not be used to cover the manager position.

In the preferred embodiment, the game ends when a player has covered all of the positions on his game board with tokens.

In a preferred variation of play, differing point values are given to each team member based upon his obscurity. For example, a readily identifiable team member would have a low point value, whereas a difficult to identify team member would have a high point value. Typically, differing point values are represented by different colored tokens, e.g. red (easy) 1 point, white (moderate) 2 points, and blue (difficult) 3 points. These tokens are then used to cover the board in the manner described above. When a player covers all of the positions on the board, the game is over. The first player to cover all of the positions on the board is awarded a predetermined number of points. Each player then counts the points accumulated by adding the point value of all tokens on his board. The points obtained by being the first player to cover the board are then totaled with the point total of the tokens. The player with the greatest number of points wins. Winners can be determined after a single round of play or multiple rounds.

The subject invention is adaptable for use with any sport or other like activity including, but not limited to, team sports such as baseball, football, hockey, basketball, soccer, rugby and lacrosse.

The following listing is indicative of the positions to be covered in the game of baseball.

| Field Positions | Bench Positions |
|---|---|
| First base | Reserve Left-Handed Pitcher |
| Second base | Reserve Right-handed Pitcher |
| Third base | Reserve Infielder |
| Outfield (3 positions) | Reserve Outfielder |
| Catcher | Manager |
| Left-Handed Pitcher | |

-continued

| Field Positions | Bench Positions |
|---|---|
| Right-Handed Pitcher | |

Variations in the subject invention could be made within the concepts taught herein. For example, a computer version of the game utilizing the concepts taught herein is to be considered within the scope of the subject invention. Hence, the invention is intended to be limited only by the scope of the claims and reasonable equivalents thereof.

What is claimed is:

1. A sports game apparatus which comprises:

(a) means for generating a number corresponding to a uniform number of a team member, such means having a first deck of cards composed of a plurality of cards, each card having a first side and a second side, with one side of each card having a uniform number printed thereon;

(b) means for generating a list of team members and their corresponding uniform numbers for a particular team in a particular year, such means having a second deck of cards composed of a plurality of cards, each card having a first side and a second side, with a team name and year printed on the first side of each card and a list of team members and their corresponding uniform numbers printed on the second side of each card; and (c) means for recording correctly guessed team member/uniform number combinations.

2. A sports game apparatus of claim 1, wherein the second side of each card in the second deck further comprises text clues relating to the team players.

3. A sports game apparatus of claim 1, wherein the cards of the second deck comprise an acid-free, laminated paper.

4. A sports game apparatus of claim 1, wherein means for recording correctly guessed team member/uniform number combinations comprises a game board.

5. A sports game apparatus of claim 4 further comprising tokens for marking correctly guessed team member/uniform number combinations on the game board.

6. A sports game apparatus of claim 5, wherein the game board depicts a sports field having spaces for recording correctly guessed team member/uniform number combinations.

7. A sports game apparatus of claim 6, wherein the spaces on the sports field are located so as to correspond to the team member's position on the field.

8. A sports game apparatus of claim 7, wherein the depicted sports field is a baseball field.

* * * * *